US005289709A

United States Patent [19]

Field

[11] Patent Number: 5,289,709

[45] Date of Patent: Mar. 1, 1994

[54] PIN TUMBLERS AND CORRESPONDING KEYS FOR CYLINDER LOCKS

[75] Inventor: Peter H. Field, Salem, Va.

[73] Assignee: Medeco Security Locks, Inc., Salem, Va.

[21] Appl. No.: 959,018

[22] Filed: Oct. 24, 1991

[51] Int. Cl.[5] ..... E05B 27/04

[52] U.S. Cl. ..... 70/494; 70/378; 70/403; 70/409

[58] Field of Search ..... 70/378, 392, 403–406, 70/409, 419, 421, 491, 493–496

[56] References Cited

U.S. PATENT DOCUMENTS

| | | | |
|---|---|---|---|
| 1,439,382 | 12/1922 | Segal . | |
| 2,408,283 | 9/1946 | Wollin | 70/419 |
| 3,499,302 | 3/1970 | Spain et al. . | |
| 3,722,240 | 3/1973 | Spain et al. | 70/494 |
| 3,731,507 | 5/1973 | Wolter | 70/358 |
| 3,738,136 | 6/1973 | Falk . | |
| 3,974,670 | 8/1976 | Wolter | 70/421 X |
| 4,098,103 | 7/1978 | Raskevicius | 70/494 |
| 4,098,104 | 7/1978 | Wolter | 70/406 |
| 4,103,526 | 8/1978 | Surko, Jr. | 70/494 |
| 4,235,086 | 11/1980 | Genakis | 70/494 |
| 4,289,002 | 9/1981 | Gretler | 70/358 |
| 4,325,241 | 4/1982 | Keller | 70/358 |
| 4,424,692 | 1/1984 | Rousseau | 70/403 X |
| 4,635,455 | 1/1987 | Oliver | 70/419 X |
| 4,756,177 | 7/1988 | Widén | 70/378 X |
| 4,760,722 | 8/1988 | Fann et al. | 70/358 |

FOREIGN PATENT DOCUMENTS

| | | | |
|---|---|---|---|
| 1533953 | 6/1968 | France | 70/421 |
| 2420007 | 10/1979 | France | 70/493 |

*Primary Examiner*—Lloyd A. Gall

*Attorney, Agent, or Firm*—Rothwell, Figg, Ernst & Kurz

[57] ABSTRACT

A tumbler pin tip and key surface are configured so that when engaged, the tumbler pin tip fully and precisely seats in the key bitting, and thus is rotationally positioned at a predetermined location. The contacting surfaces are generally sloped from one edge of the tumbler (and key surface) to the other in tapered form and the sloping surface may be flat, concave, convex or a combination as disclosed.

14 Claims, 4 Drawing Sheets

PIN TUMBLERS AND CORRESPONDING KEYS FOR CYLINDER LOCKS

FIELD OF THE INVENTION

This invention relates to improvements in cylinder locks and particularly to the shapes of tumbler pin tips and the corresponding key bitting surfaces.

BACKGROUND AND PRIOR ART

Yale type cylinder subassemblies have been well known since 1865. Typically, differences between cylinders have been developed by adjusting incrementally the lengths of the tumbler pins in the cylinder and key differs are generated by varying the corresponding depths of the bittings on the key. Variations in the shape of the tip of the tumbler pins are not new. In the case of Taylor, U.S. Pat. No. 457,753 (1891), these variations provide masterkeying capabilities.

The positioning of tumbler pins by keys has been the subject of continuous improvement and much work in the lock art. The Spain et al. patent, U.S. Pat. No. 3,499,302 (1970), disclosed tumbler pins with chisel-shaped tips which were rotatable to predetermined positions by skew cut key bittings to operate in conjunction with a side bar mechanism. Another Spain et al. patent, U.S. Pat. No. 3,722,240, is an improvement on the locking mechanism using unique rotating tumblers for cooperation with another sidebar. These patents improved the state of the lock cylinder art by disclosing tumbler pins in cylinder mechanisms whereby the tumbler pins were adjusted rotationally in addition to the traditional elevational positioning. In a six-pin cylinder, the ability to rotate each pin to the three positions Spain uses, increases the bitting and combination potential from 1,000,000 to 729,000,000 unique keys.

With the advent of elevational and rotational positioning of a tumbler pin within a cylinder, the sides and shapes of the tumbler pin tip and the bitting surface became a significant factor in the operation of the cylinder. The introduction of the skew cut bittings into the cylinder forced the tumbler pins to rotate to a precise position. Irregularly configured, or imprecise surfaces on either the tumbler pin tip or the corresponding key bitting surface would not correctly position the tumbler pin and allow operation of the cylinder. A more recent patent to Oliver, U.S. Pat. No. 4,635,455 (1987), discloses offsetting the tip of a chisel pointed tumbler. This increases the theoretical bitting and combination possibilities of a six-pin tumbler cylinder to 46,656,000,000. Keys manufactured to operate with offset tumbler pin tips are not interchangeable with keys for cylinders whose pin tips are not offset. These slight variations are significant to the art of cylinders with rotating pins.

The patent to Widen, U.S. Pat. No. 4,756,177 (1988), discloses a rotating tumbler pin with a rounded finger projecting transversely outwardly from the body of the pin for cooperation with a configured side surface of a key blade.

The patent to Falk, U.S. Pat. No. 3,738,136 (1973) shows an arrangement of tumblers which are positioned parallel to the axis of a cylindrical key blade.

Other prior patents in the art have disclosed tumblers operated with flat keys. Typically, the tumbler tip configurations are frustoconical, or chisel pointed. See, for example, U.S. Patents to Gretler U.S. Pat. No. 4,289,002 (1981), Keller U.S. Pat. No. 4,325,241 (1982), and Fann et al. U.S. Pat. No. 4,760,722 (1988). Tumbler pins are also known which use offset arrangements to preclude rotation, e.g., U.S. Patents to Wolter, U.S. Pat. No. 3,731,507 (1973) and U.S. Pat. No. 4,098,104 (1978).

Increasing the number of key bitting increments results in a higher number of unique key differs. This greatly reduces the potential for any key operating a cylinder other than its own. Patents issued for the great majority of lock cylinders on the market have expired. Their keys can be copied on conventional machines of the type described in U.S. Patent to Segal U.S. Pat. No. 1,439,382 (1922). The keyblanks required are widely distributed beyond the control of the lock manufacturer. The development of skew cut bittings provided additional security to the key owner because conventional rotary machines would not duplicate these angled cuts. As there have been machines developed to duplicate skew cut bittings, their security is reduced. Uniquely shaped bittings and controlled distribution of proprietary keyblanks reduces the odds that keys in the possession of dishonest employees can be copied at hardware stores and the like.

Notwithstanding improvements in the well worked locking arts, there remains a continuous need for mechanisms which can provide an extraordinary number of unique keys which are not subject to unauthorized duplication. There is also a need for lock mechanisms which resist contemporary lockpicking techniques, including impressioning methods to obtain false keys. It is also desirable that the dimensions of the lock not exceed conventional cylinder size. It is equally important that the components can be economically mass produced.

SUMMARY OF THE INVENTION

This invention provides an extraordinarily large number of key differs using rotationally and possibly elevationally and/or axially movable locking tumblers which have high resistance to picking, do not exceed the limitations of industry standards, and are compatible for mass production.

These objectives are accomplished in part by a lock mechanism which uses at least one rotatable tumbler pin of the general type known in the prior art provided with a tapered tip which generally slopes from one side edge of the tumbler to the other. This tapered tip may be flat, rounded (convex or concave), or partially flat or partially rounded. The tumbler tip surface is adapted to engage with a configured key blade surface which is formed in a substantially complementary shape with a sloping surface so that when the two sloping surfaces contact, the tumbler pin under axial bias will seek to accommodate the sloping surface of the key and will rotate until the surfaces of the key and tumbler pin tip match, thus aligning the tumbler pin at a position predetermined by the key bitting.

DETAILED DESCRIPTIONS OF THE PREFERRED EMBODIMENTS

Figures 1A, 1B, 1C, 1D, 1E, 1F, 1G, 6A, 6B, 6C, 6D, 6E, 6F, 6G:
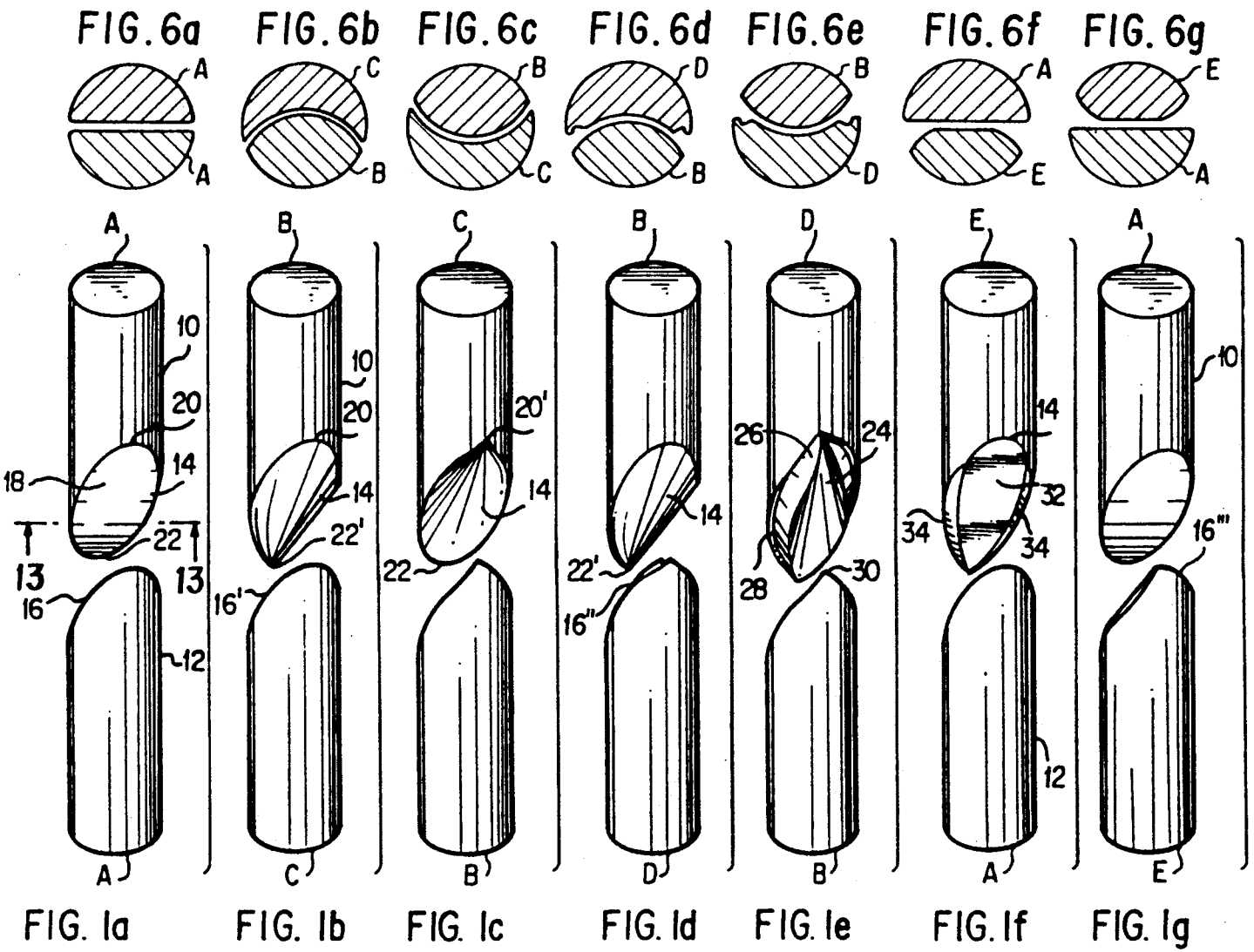
FIGS. 1*a*–1*g* are side elevational views illustrating the surfaces of a tumbler pin tip and complementary configured key surface which constitute this invention.
FIGS. 6*a*-6*g* are sectional views taken along line 13--13 of the tumbler pin tips and complementary key surfaces as shown in FIGS. 1*a*-1*g*.

With reference to FIGS 1*a* though 1*g*, each set of elements represents a rotatable tumbler pin 10 and a corresponding key bitting surface configuration 16. The tumbler pin 10 would be retained in a tumbler pin bore as disclosed in the patents discussed above. The key configuration 12 is only a representative portion of the key at the tumbler pin contact area for illustrative purposes, the actual key would be along the lines shown in FIGS. 2-5.

The tumbler pin body 10 is generally cylindrical and operates in a bore and typically would be biased towards the key as is known in the art. This invention resides primarily in the contact surface configuration of the tumbler pin tip 14 and a cooperating contact surface 16 of the mating key 12. In general, the cooperating contact surfaces are complementary in shape. As shown in FIG. 1*a*, the tumbler pin 10 and key portion 12 are designated by the letter "A" which indicates that their surfaces are identical, the tumbler pin tip surface 14 has a flat sloping surface 18 which surface slopes from one side 20 to the other side 22. This flat sloping surface is identical to the cooperating key contact surface 16. When the key surface 16 contacts a tumbler pin tip surface 18 and they are both of the configuration A—A shown in FIG. 1*a*, the tumbler, confined in its bore, will rotate about its axis under spring bias applied to the tumbler pins or weight or other bias in order that the complementary surfaces 14 and 16 mate. The alignment of the bitting surface 16 on the key thus determines the rotational position of the tumbler pin 10.

FIG. 1*b* and 1*c* show tumbler B and key portion C and tumbler C and key portion B, respectively. In these FIGURES, the tumbler 10 has its tip 14 in a curved convex form from edge 20 to opposite edge 22'. By providing a convex form, there is a point at edge 22'. The mating element of the key portion C is surface 16' which is complementarily concave from side edge to side edge of the key surface configuration. Again, the operation is the same, namely, at contact with the key bitting area the tumbler pin tip seeks a full mating position and will rotate to achieve this match. Thus the position of the bitting surface 16' on the key determines the position of the tumbler pin 10.

In FIG. 1*c*, the tumbler pin C is concave and the key portion B is convex. The tip 14 of the tumbler pin C is concave from side 22 to opposite side 20' which has a small depression complementary to the point on the key configuration. The interaction of the key bitting surface and the tumbler pin is the same as described above.

FIGS. 1*d* and 1*e* illustrate two other possibilities using convex tumbler pin denoted B with a key configuration indicated D, and vice versa. The convex tumbler pin tip 14 of tumbler B mates with a shape of surface 16'' of key portion D. As shown in FIG. 1*e*, part D includes a portion 24 which is concave to mate with the convex surface of B, while having a small shaped side portion 26 on both sides and surrounded by a small grooved portion 28 which cooperates with a tip 30 on the mating surface. Again, the operation is the same as discussed above, the tumbler pin being restrained within a bore and biased towards the key, will continue to mate with the complementary portion of the bitting surface on the key and will rotate around with point 30 riding in groove 28 until the full mating is accomplished with the convex surface resting in concave surface 24.

FIGS. 1*f* and 1*g* are again illustrative of complementary mating elements utilizing a tumbler pin or key bitting elements A and a key bitting or tumbler pin designated E. In these embodiments, the pin tumbler tip 14 (or key surface 16''') has a flat area 32 surrounded on both sides with tapered or beveled areas 34. Again, the operation is as described above, with the insertion of the key into the cylinder, the tumbler pin tip will come into contact with the key bitting surface, the tumbler pin being free to rotate, will rotate until the flat surface 32 contacts the corresponding flat surface on the mating member, the side surfaces 34 assisting in the rotation.

Figure 2:
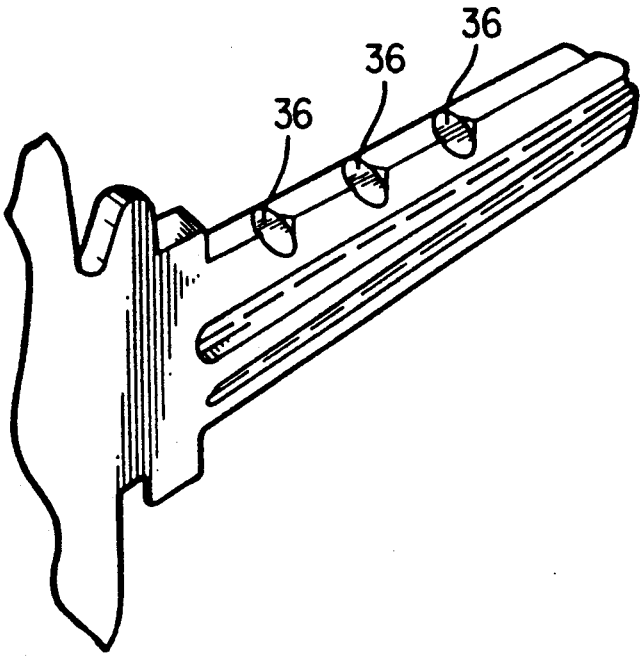
FIG. 2 is a perspective view illustrating a conventional, generally rectangular, grooved key blade having the complementary configured portions formed in a top edge surface thereof.

FIG. 2 is one illustration of a key for a lock utilizing these unique tumbler pins. One or more bitting areas 36 are positioned along the top edge of the key blade and are shaped, cut, or bitted according to the configurations in the bottom row of FIGS. 1*a*-1*g* to meet with the tumbler pins in the top row of FIGS. 1*a*-1*g* and to operate as described.

Figure 3:
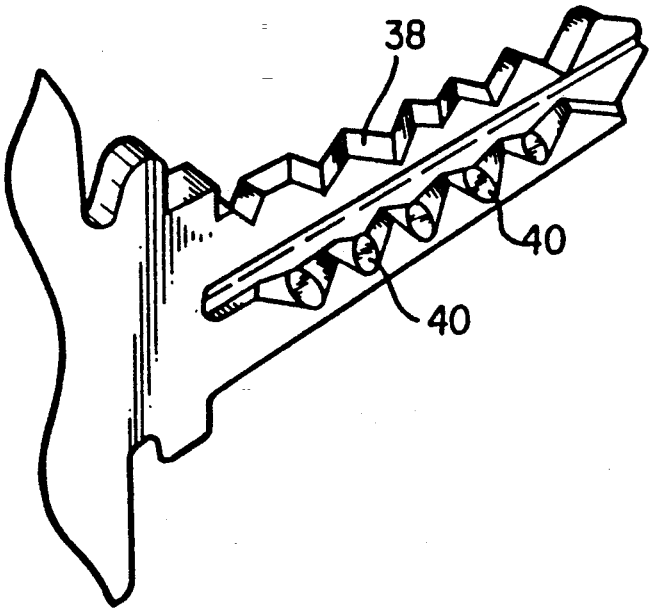
FIG. 3 is a perspective view of a key blade of the type shown in the Widen patent with the complementary surfaces in a side face of a generally rectangular key blade.

FIG. 3 is another variation of a key. The blade has conventional bittings 38 on its top edge and additional bittings 40 are positioned along one or more of its lower sides. These secondary bittings are configured with the sloping surfaces as illustrated in FIGS. 1*a*-1*g*.

Figure 3A:
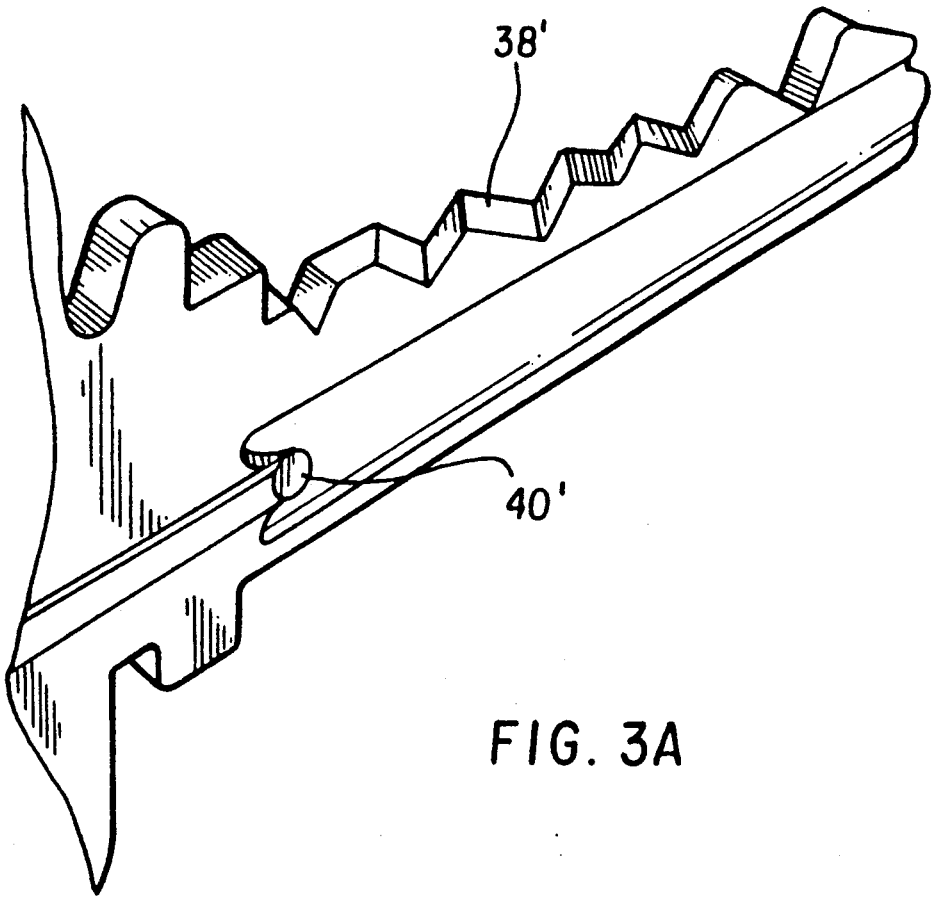
FIG. 3A is a perspective view of a generally rectangular key blade with a complementary surface shown in a side face.

FIG. 3A is another variation of a key with secondary bittings on a side surface. The blade has conventional bittings 38' on its top edge and an additional bitting 40' is positioned on at least one of the side surfaces. The secondary bitting is configured with the sloping surfaces as illustrated in FIGS. 1*a*-1*g*.

Figure 4:
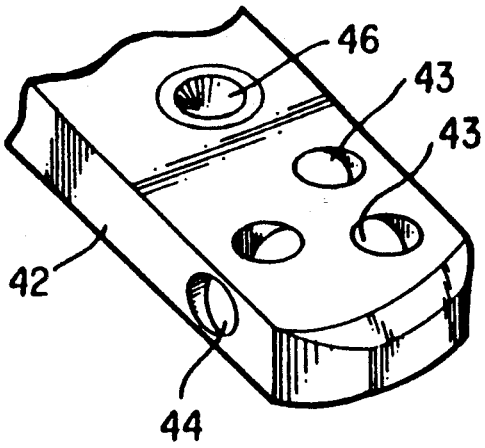
FIG. 4 is a partial perspective view of a flat key having complementary surfaces formed in either face or side edge thereof, and also illustrating bittings at offset locations.

FIG. 4 is a portion of a key 42 for a lock of the type in which a tumbler pin is positioned by a flat key. For example, see U.S. Pat. No. 4,289,002. In this case, the bitting holes 43 in the surface of the key, or the bitting hole 44 in the side of the key, tapers from one edge to the other as described above. Additionally, rotational positioning of an offset tip tumbler pin can be effected by positioning a conical bitting hole 46 so that its apex is offset from the axis of the tumbler pin bore. Also bitting hole 46 is offset from a line through the centers of bitting holes 43.

Figure 5:
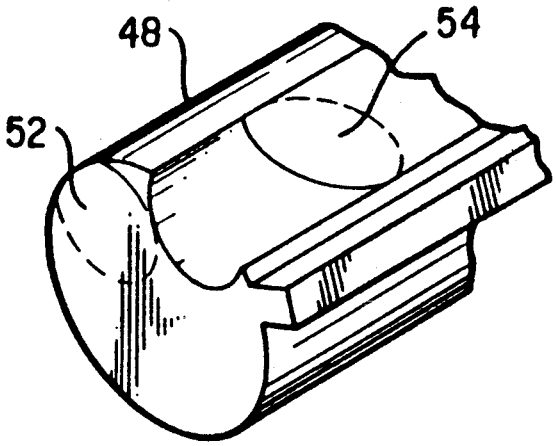
FIG. 5 is a perspective view of a portion of a key for an axial tumbler lock showing a possibility of bitting surfaces.

FIG. 5 is a perspective view of a portion of a key 48 for operating an axial pin tumbler lock, see, e.g., U.S. Pat. No. 3,738,136. In this improvement, the tapered bitting surface could be in the fore end of the cylinder shown at 52 or in a side surface as at 54.

With reference to FIGS. 6*a*-6*g*, each set of elements represents a cross-sectional view taken on line 13—13 of a rotatable tumbler pin and a corresponding key bitting surface configuration as shown in FIGS. 1*a*-1*g*.

In FIG. 6*a*, the tumbler pin tip and the corresponding key portion are both designated by the letter "A" to show that their surfaces are the same as the pin and key designated "A" in FIG. 1*a*.

FIGS. 6*b* and 6*c* show tumbler "B" and key portion "C" and tumbler "C" and key portion "B", respectively.

In FIGS. 6*d* and 6*e*, the convex tumbler pin is designated "B" and mates with a shaped bitting surface on the key denoted "D", and vice-versa.

In FIGS. 6*f* and 6*g*, one of the mating surfaces on the pin or the bitting key portion is surrounded with tapered areas.

If desired, a tumbler pin rotational constraint device such as grooves, cooperating with a projection (not shown), may be used to limit the rotation of the tumbler pin and to prevent the high edge of the tumbler pin tip from contacting the high edge of the key surface.

As can be seen, this invention solves a number of problems in making an easily manufacturable tumbler pin with complementary key surface in which the surface of the tumbler pin slopes from one side edge to the other so that it can be precisely positioned within a lock cylinder by a complementary mating surface on the key.

I claim:

1. A method of rotating tumbler pins in tumbler pin bores of a cylinder lock by means of a configured key, the method comprising; providing a surface on a tip portion of a tumbler pin to slope generally from one side edge to the other side edge of the tumbler pin to provide a single slanted contact surface, forming a surface on the key which is generally complementary to the single slanted contact surface on the tip of the tumbler portion, contacting the surfaces by inserting the key in the lock and biasing one of the surfaces against the other so that the tumbler pin rotates until the complementary single slanted contact surfaces are in full contact with each other.

2. At least one tumbler pin and key for a cylinder lock, having improvements comprising; at least one tumbler pin tip surface shaped to slope from adjacent one side surface of the tumbler pin to adjacent an opposite side surface of the tumbler pin to provide a single slanting contact surface, and at least one key blade surface shaped substantially complementary to the tumbler pin tip so that when the key blade surface and tumbler pin tip are in initial partial contact, the bitted key surface will cause the tumbler pin tip single slanting contact surface to move into contact along the complementary shaped key surface, thereby causing the tumbler pin to rotate about its axis and be positioned to a proper unlocking position.

3. At least one tumbler pin and key for a cylinder lock as defined in claim 2 wherein the tumbler pin tip surface and key blade surface are flat sloping surfaces throughout their contact area.

4. At least one tumbler pin and key for a cylinder lock as defined in claim 2 wherein at least one of the surfaces is a curved convex surface and the other of the surfaces is a curved concave surface.

5. At least one tumbler pin and key for a cylinder lock as defined in claim 2 wherein at least one of the sloping tumbler pin tips and cooperating key blade surface is a curved convex surface, and the other is partially concave in the central potion of the surface and is surrounded on both sides by a shaped side portion.

6. At least one tumbler pin and key for a cylinder lock as defined in claim 5 wherein at least one of the sloping tumbler pin tips and cooperating blade surfaces is a curved convex surface with a pointed tip and the other is partially concave is the central portion and is surrounded on both sides by a groove between the shaped side portion and central portion, the groove cooperating with the pointed tip of the curved convex surface.

7. At least one tumbler pin and key for a cylinder lock as defined in claim 2 wherein at least one of the sloping tumbler pin tips and cooperating key blade surfaces is a flat sloping surface and the other surface has a flat central portion in the sloping center extending from one surface to an opposite surface with bevelled shaped surfaces adjoining both edges of the flat central portion.

8. At least one tumbler pin and key for a cylinder lock as defined in claim 2 wherein the key blade is of a generally rectangular shape with at least one of the complementary shaped areas formed in at least a top edge.

9. At least one tumbler pin and key for a cylinder lock as defined in claim 2 wherein the key blade is of a generally rectangular shape with at least one of the complementary shaped areas formed in at least a side face.

10. At least one tumbler pin and key for a cylinder lock as defined in claim 2 wherein the key blade is of a generally flat shape with at least one of the complementary shaped areas formed in at least a side face.

11. At least one tumbler pin and key for a cylinder lock as defined in claim 10 wherein at least one of the shaped areas is at least one substantially conical hole in the key blade, the apex of the hole being offset from the location of the axis of a corresponding tumbler pin bore.

12. At least one tumbler pin and key for a cylinder lock as defined in claim 2 wherein the key blade is of a generally flat shape with at least some of the complementary bitting areas formed in the edges.

13. At least one tumbler pin and key for a cylinder lock as defined in claim 2 wherein the key blade is of a generally cylindrical shape with at least some complementary bitting surfaces formed in the fore end.

14. At least one tumbler pin and key for a cylinder lock as defined in claim 2 wherein the key blade is of a generally cylindrical shape with at least some complementary bitting areas formed in the side.

* * * * *